US005869442A

United States Patent [19]

Srinivas et al.

[11] Patent Number: 5,869,442

[45] Date of Patent: Feb. 9, 1999

[54] FABRIC SOFTENING COMPOSITIONS WITH DYE TRANSFER INHIBITORS FOR IMPROVED FABRIC APPEARANCE

[75] Inventors: Bala Srinivas, Hasbrouck Heights; Jenn S. Shih, Paramus; John C. Hornby, Washington Township, all of N.J.

[73] Assignee: ISP Investments Inc., Wilmington, Del.

[21] Appl. No.: 105,630

[22] Filed: Jun. 26, 1998

Related U.S. Application Data

[63] Continuation-in-part of Ser. No. 932,448, Sep. 19, 1997, Pat. No. 5,776,879.

[51] Int. Cl.[6] ..... C11D 1/94

[52] U.S. Cl. ..... 510/476; 510/516; 510/519; 510/522

[58] Field of Search ..... 510/361, 476, 510/513, 519, 522, 516; 526/265, 318.1

[56] References Cited

U.S. PATENT DOCUMENTS

| | | | |
|---|---|---|---|
| 4,452,878 | 6/1984 | Locatell, Jr. et al. | 430/215 |
| 5,459,007 | 10/1995 | Larson et al. | 430/115 |
| 5,573,882 | 11/1996 | Larson et al. | 430/115 |
| 5,776,879 | 7/1998 | Shih et al. | 510/361 |

FOREIGN PATENT DOCUMENTS

0231038 B1 5/1991 European Pat. Off. .

OTHER PUBLICATIONS

V.A. Kabanov, A.A. Yaroslavov, S.A. Sukhishvili, Journal of Controlled Release, vol. 39, pp. 173–189, Jan. 1996.

C. Luca, V.Barboiu, I. Petrariu, M. Dima, Journal of Polymer Science, Polymer Chemistry Edition, 2347–2355 Jun. 1980.

*Primary Examiner*—Paul Lieberman

*Assistant Examiner*—John R. Hardee

*Attorney, Agent, or Firm*—Walter Katz; William J. Davis; Marilyn J. Maue

[57] ABSTRACT

A fabric softening composition capable of reducing the transfer of dyes during subsequent wash cycles comprising:

I. an effective amount of fabric softening agent; and

II. an effective amount of water-soluble polymeric dye transfer inhibitor which is a poly(vinylpyridine betaine containing a quaternary nitrogen and a carboxylate salt having dye transfer inhibitor properties having the formula:

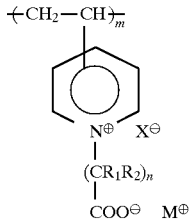

where m defines a repeating unit;

X is an anion;

R and $R_2$ are independently hydrogen, alkyl or aryl;

n is 1–5; and

M is a cation; and copolymers thereof.

22 Claims, No Drawings

FABRIC SOFTENING COMPOSITIONS WITH DYE TRANSFER INHIBITORS FOR IMPROVED FABRIC APPEARANCE

CROSS-REFERENCE TO RELATED U.S. PATENT APPLICATIONS

This application is a continuation-in-part of U.S. patent application Ser. No. 08/932,448, now U.S. Pat. No. 5,776,879 filed Sep. 19, 1997, by the same inventors as herein (FDN-2474/2478).

BACKGROUND OF THE INVENTION

1. Field of the Invention

This invention relates to compositions and processes useful for inhibiting the transfer of dyes, released into laundering solution from colored fabrics, from one fabric to another, and more particularly, to effective dye complexing polymers for use therein.

2. Description of the Prior Art

One troublesome and persistent problem during laundering operations is the tendency of some colored fabrics to release dye into the laundering solution which dye is then transferred onto other fabrics.

Manufacturers use many types of dye to color fabrics. Common fabric dyes include direct dyes used primarily to color cotton and rayon, acid dyes used primarily on nylon, wool, and silk, disperse dyes used primarily on polyester, nylon, and Spandex, azo dyes used primarily on cotton, rayon, and silk, reactive dyes used primarily on cotton and rayon, and vat dyes used primarily on cotton. Direct, acid and disperse dyes are in general readily released into washing solution while azo and vat dyes are not. When properly applied, reactive dyes chemically bond to cellulose and therefore are not readily solubilized; however, if improperly applied, reactive dyes may also release into the wash solution. Cotton, nylon, rayon and Spandex fabrics have a strong propensity to pick up solubilized or suspended dyes from solution, while polyester fabrics pick up such dyes to a lesser extent.

In the laundry operation, especially the operation involving automatic washing machines, dye transfer occurs mainly during the wash cycle, and very seldom, if at all, during the rinse cycle. Dye transfer during the wash cycle is caused by higher water temperature, longer cycle time, and much higher surfactant concentration in the wash cycle, as compared to the less stringent conditions of the rinse cycle.

Thus, those skilled in the art have focused efforts to inhibit dye transfer by adding dye transfer inhibitors to detergent compositions. For example, European Patent Application 265,257, Clements et al., published Apr. 27, 1988, discloses detergent compositions which prevent dye transfer, containing a detergent active (mixtures of anionic and nonionic are preferred), a detergent builder, and a polyvinylpyrrolidone (PVP) mixture. German Pat. No. 3,519,012, Weber et al., published Nov. 27, 1986, teaches a detergent composition comprising nonionic surfactants, PVP components, water-soluble cationic components, and builders, to prevent dye transfer during the wash.

Dye transfer inhibitors (DTI), such as PVP, appear to solubilize into the wash water to scavenge the free dye molecules, thus suspending the dyes and preventing them from redepositing onto fabrics.

DTI may interact with some detergent actives. For example, detergent compositions containing PVP and anionic surfactants usually have decreased dye transfer inhibition performance compared to those detergents containing PVP and nonionic surfactants. It is believed that anionic surfactants interact with PVP in the wash cycle, and reduce PVP's ability to interact with free dye molecules.

The prior art in this field is represented by the following patents and publications:

| Patent | Subject Matter |
|---|---|
| (1) JP 53-50732 | Formulas Nos. 3, 6 and (1) are water insoluble compounds and polymers used in printing ink compositions; |
| (2) PCT/US94/06849 WO 95/03390 | Dye inhibiting composition polymers of PVP, polyamine N-oxide, vinylimidazole are used in laundry detergent compositions; |
| (3) U.S. Pat. No. 5,460,752 | Polyamine N-oxide polymers described for use in laundry detergent compositions; |
| (4) EPA 664335 A1 | Polysulfoxide polymers; |
| (5) PCT/US93/10542 WO 94/11473 | Laundry compositions include polyamine-N-oxide and brighteners and surfactants; |
| (6) PCT/EP93/02851 WO 94/10281 | PVP and PVI are present in laundry compositions; |
| (7) PCT/US94/11509 WO 95/13354 | Poly(4-vinylpyridine-N-oxide) (PVPNO) and copolymers of VP and VI are described; |
| (8) EP 754748 A1 | Vinylpyridine copolymers and formic acid; |
| (9) EP 0664332A1 | Polyamine oxide polymers; |
| (10) U.S. Pat. No. 5,604,197 | PVPNO + clay softening; |
| (11) U.S. Pat. No. 5,458,809 | PVPNO; |
| (12) U.S. Pat. No. 5,466,802 | PVPNO and PVP-VI; |
| (13) U.S. Pat. No. 5,627,151 | Copolymers of VP or VI; vinylpyridine or dimethylaminoethyl methacrylate or dimethylaminopropylmethacrylamide, including up to 20% vinylacetate; |
| (14) PCT/US95/04019 WO 95/27038 | PVPNO, PVP, PVP-PI and copolymers of VP and VI; |
| (15) EPA 628624 A1 | PVPNO with protease; |
| (16) DE 4224762 A1 | VP polymers; |
| (17) J. Polymer Sci. 26, No. 113, p. 25–254 (1957) | Water-insoluble poly(4-vinylpyridine) compounds and polymers |
| (18) PCT/US93/10451 | Fabric softener compositions containing PVP as DTI |

All percentages, ratios, and parts herein are by weight unless otherwise stated.

SUMMARY OF THE INVENTION

The compositions of the present invention preferably incorporate water-soluble poly(vinylpyridine betaine) polymers which contain a quaternary nitrogen and a carboxylate salt into fabric softening compositions to be added to the rinse and/or drying cycles of the laundry operation. Surprisingly, these fabric softening compositions provide effective dye transfer inhibition in the subsequent wash cycle. These water-soluble polymers deposit on fabrics along with softener actives in the rinse or dryer cycle. These DTI polymers remain deposited on fabrics throughout consumer wear so that there is a sufficient concentration, after resolubilization in the subsequent wash solution, to inhibit dye transfer. Non-treated fabrics will also be protected from dye transfer when washed with fabrics previously treated with these softener compositions containing polymeric dye transfer inhibitors. It is also surprising that these polymer compounds in softener compositions show improved efficacy when anionic detergents rather than nonionic detergents are used in the subsequent wash cycle.

Thus, the present invention relates primarily to fabric softening compositions, in liquid, solid, or dryer sheet form, for use in the rinse and/or dryer cycles of home laundry operations. The present invention is based on: (a) the discovery that the incorporation of an effective amount of certain polymeric dye transfer inhibitors (DTI) into liquid, solid, and/or dryer-added fabric softening compositions can effectively inhibit the transfer of dyes from one fabric to another in the subsequent wash cycle; and/or (b) the discovery of a process of incorporating DTI into fabric softener compositions to provide convenient and/or optimal dye transfer inhibition, remove unwanted dye discoloration resulting from previous dye transfer, and/or provide soil anti-redeposition benefit in the wash cycle.

Preferably, and more specifically, fabric softening compositions are provided in the form of liquid, preferably aqueous, compositions comprising:

I. from about 3% to about 50%, preferably from about 4to about 30%, of fabric softening agent (fabric softener); and II. from about 0.03to about 25%, preferably from about 0.1% to about 15%, of water-soluble polymeric dye transfer inhibiting agent (dye transfer inhibitor or DTI) having the formula:

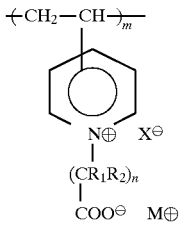

where m is indicative of the degree of polymerization;

X is an anion;

$R_1$ and $R_2$ are independently hydrogen, alkyl or aryl;

n is 1–5; and

M is a cation.

Preferred embodiments of the invention are polymers in which X is a halide; most preferably chloride or bromide; $R_1$ and $R_2$ are both hydrogen; n is 1; M is an alkali metal; preferably sodium or potassium; and the polymer is 25–100% quaternized; most preferably 75–100%.

A preferred polymer has a weight average molecular weight of about 5,000 to 1,000,000; preferably 20,000 to 200,000, where m is about 30–5000, preferably 100–1000. Water soluble copolymers of the defined polymer above with polymerizable monomers, such as vinyl pyrrolidone, vinyl imidazole, acrylamide and vinyl caprolactam also are useful herein.

III. The balance comprising a liquid carrier, preferably water; wherein the liquid compositions are essentially free of aerosol propellants.

The present invention also comprises dryer-added fabric softener compositions comprising:

I. from about 50% to about 99%, preferably from about 70% to about 99%, of fabric softening agent;

II. from about 0.2% to about 50%, preferably from about 1% to about 30%, of polymeric dye transfer inhibiting agent selected from (A), (B), (C), and (D), above; and III. optionally, a dispensing means which provides for release of an effective amount of said composition to fabrics.

Solid, particulate fabric softening compositions of the present invention typically comprise I. from about 20% to about 90%, preferably from about 30% to about 70%, of fabric softening agent; and II. from about 0.1% to about 80%, preferably from about 0.3% to about 50%, more preferably from about 0.5% to about 25%, of dye transfer inhibiting agent also selected from (A), (B), (c), and (D), above.

DETAILED DESCRIPTION OF THE INVENTION LIQUID COMPOSITIONS

Liquid, preferably aqueous, fabric softening compositions typically comprise the following components:

I. an effective amount, preferably from about 3% to about 50%, more preferably from about 4% to about 30%, of fabric softening agent;

II. an effective amount, preferably from about 0.03% to about 25%, more preferably from about 0.1% to about 15%, of polymeric dye transfer inhibiting agent; and III. the balance comprising liquid carrier, preferably, selected from the group consisting of water, $C_1$–$C_4$ monohydric alcohols, $C_2$–$C_6$ polyhydric alcohols, liquid polyalkylene glycols, and mixtures thereof.

I. Fabric Softening Agents

The amount of fabric softening agent (fabric softener) in liquid compositions of this invention is typically from about 3% to about 50%, preferably from about 4% to about 30%, by weight of the composition. The lower limits are amounts needed to contribute effective fabric softening performance when added to laundry rinse baths in the manner which is customary in home laundry practice. The higher limits are suitable for concentrated products which provide the consumer with more economical usage due to a reduction of packaging and distributing costs.

Some preferred compositions are disclosed in U.S. Pat. No. 4,661,269, issued Apr. 28, 1987, in the names of Toan Trinh, Errol H. Wahl, Donald M. Swartley, and Ronald L. Hemingway, said patent being incorporated herein by reference.

Other fabric softeners that can be used herein are disclosed in U.S. Pat. No. : 3,861,870, Edards and Diehl; U.S. Pat. No. 4,308,151, Cambre; U.S. Pat. No. 3,886,075, Bernardino; U.S. Pat. No. 4,233,164, Davis; U.S. Pat. No. 4,401,578, Verbruggen; U.S. Pat. No. 3,974,076, Wiersema and Rieke; and U.S. Pat. No. 4,237,016, Rudkin, Clint, and Young, all of said patents being incorporated herein by reference.

One suitable fabric softener (Component I) is a mixture comprising:

(a) from about 10% to about 80% of the reaction product of higher fatty acids with a polyamine selected from the group consisting of hydroxyalkylalkylene diamines and dialkylenetriamines and mixtures thereof;

(b) from about 3% to about 40% of cationic nitrogenous salts containing only one long chain acyclic aliphatic $C_{15}$–$C_{22}$ hydrocarbon group; and (c) from about 10% to about 80% of cationic nitrogenous salts having two or more long chain acyclic aliphatic $C_{15}$–$C_{22}$ hydrocarbon groups or one said group and an arylalkyl group; said (a), (b) and (c) percentages being by weight of Component I.

Following are the general descriptions of the above softener ingredients including certain specific examples. These examples illustrate, but do not limit the present invention.

Component I(a)

A preferred softening agent (active) of the present invention is the reaction products of higher fatty acids with a polyamine selected from the group consisting of hydroxyalkylalkylene diamines and dialkylenetriamines and mixtures thereof. These reaction products are mixtures of several compounds in view of the multifunctional structure of the polyamines.

The preferred Component I(a) is a nitrogenous compound selected from the group consisting of the reaction product mixtures or some selected components of the mixtures. More specifically, the preferred Component I(a) is compounds selected from the group consisting of:

(i) the reaction product of higher fatty acids with hyroxyalkylalkylenediamines in a molecular ratio of about 2:1, said reaction product containing a composition having a compound of the formula:

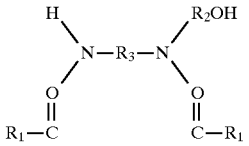

wherein $R_1$ is an acyclic aliphatic $C_{15}$–$C_{21}$ hydrocarbon group and $R_2$ and $R_3$ are divalent $C_1$–$C_3$ alkylene groups;

(ii) substituted imidazoline compounds having the formula:

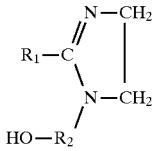

wherein $R_1$ and $R_2$ are defined as above;

(iii) substituted imidazoline compounds having the formula:

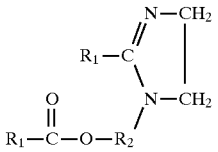

wherein $R_1$ and $R_2$ are defined as above;

(iv) the reaction product of higher fatty acids with dialkylenetriamines in a molecular ratio of about 2:1, said reaction product containing a composition having a compound of the formula:

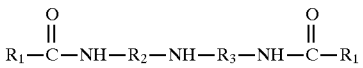

wherein $R_1$, $R_2$ and $R_3$ are defined as above; and (v) substituted imidazoline compounds having the formula:

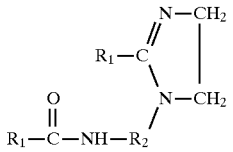

wherein $R_1$ and $R_2$ are defined as above; and (vi) mixtures thereof.

Component I(a)(i) is commercially available as Mazamide® 6, sold by Mazer Chemicals, or Ceranine® HC, sold by Sandoz Colors & Chemicals; here the higher fatty acids are hydrogenated tallow fatty acids and the hydroxyalkylalkylene diamine is N-2-hydroxyethylethylenediamine, and $R_1$ is an aliphatic $C_{15}$–$C_{17}$ hydrocarbon group and $R_2$ and $R_3$ are divalent ethylene groups.

An example of Component I(a)(ii) is stearic hydroxyethyl imidazoline wherein $R_1$ is an aliphatic $C_{17}$ hydrocarbon group, $R_2$ is a divalent ethylene group.

An example of Component I(a)(iv) is N,N'-ditallowalkoyldiethylenetriamine where $R_1$ is an aliphatic $C_{15}$–$C_{17}$ hydrocarbon group and $R_2$ and $R_3$ are divalent ethylene groups.

An example of Component I(a)(v) is 1-tallowamidoethyl-2-tallowimidazoline wherein $R_1$ is an aliphatic $C_{15}$–$C_{17}$ hydrocarbon group and $R_2$ is a divalent ethylene group.

The Components I(a)(iii) and I(a)(v) can also be first dispersed in a Bronsted acid dispersing aid having a pKa value of not greater than about 4; provided that the pH of the final composition is not greater than about 5. Some preferred dispersing aids are hydrochloric acid, phosphoric acid, or methylsulfonic acid.

Both N,N"-ditallowalkoyldiethylenetriamine and 1-tallow(amidoethyl)-2-tallowimidazoline are reaction products of tallow fatty acids and diethylenetriamine, and are precursors of the cationic fabric softening agent methyl-1-tallowamidoethyl-2-tallowimidazolinium methylsulfate (see "Cationic Surface Active Agents as Fabric Softeners," R. R. Egan, Journal of the American Oil Chemicals' Society, January 1978, pages 118–121). N, N"-ditallowalkoyldiethylenetraimine and 1-tallowamidoethyl-2-tallowimidazoline can be obtained from Sherex Chemical Company as experimental chemicals. Methyl-1-tallowamidoethyl-2-tallowimidazolinium methylsulfte is sold by Sherex Chemical Company under the trade name Varisoft® 474.

Component I(b)

The preferred Component I(b) is a cationic nitrogenous salt containing one long chain acyclic aliphatic $C_{15}$–$C_{22}$ hydrocarbon group selected from the group consisting of:

(i) acyclic quaternary ammonium salts having the formula:

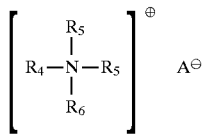

wherein $R_4$ is an acyclic aliphatic $C_{15}$–$C_{22}$ hydrocarbon group, $R_5$ and $R_6$ are $C_1$–$C_4$ saturated alkyl or hydroxyalkyl groups, and $A^{\ominus}$ is an anion;

(ii) substituted imidazolinium salts having the formula:

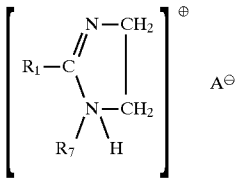

wherein $R_1$ is an acyclic aliphatic $C_{15}$–$C_{21}$ hydrocarbon group, $R_7$ is a hydrogen or a $C_1$–$C_4$ saturated alkyl or hydroxyalkyl group, and $A^\theta$ is an anion;

(iii) substituted imidazolinium salts having the formula:

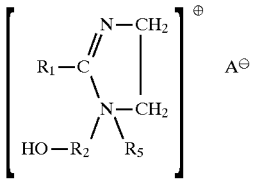

wherein $R_2$ is a divalent $C_1$–$C_3$ alkylene group and $R_1$, $R_5$ and $A^\theta$ are as defined above;

(iv) alkylpyridinium salts having the formula:

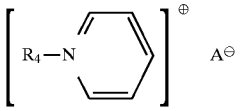

wherein $R_4$ is an acyclic aliphatic $C_{16}$–$C_{22}$ hydrocarbon group and $A^\theta$ is an anion; and (v) alkanamide alkylene pyridinium salts having the formula:

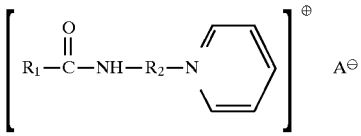

wherein $R_1$ is an acyclic aliphatic $C_{15}$–$C_{21}$ hydrocarbon group, $R_2$ is a divalent $C_1$–$C_3$ alkylene group, and $A^\theta$ is an ion group;

(vi) monoester quaternary ammonium compounds having the formula:

$[(R)_3—N^{\oplus}—(CH_2)_n—Y—R^2]\ A^\theta$ wherein each Y=—O—(O)C—, or —C(O)—O—;

each n=1 to 4;

each R substituent is a short chain $C_1$–$C_6$, preferably $C_1$–$C_3$ alkyl or hydroxyalkyl group, e.g., methyl (most preferred), ethyl, propyl, hydroxyethyl, and the like, benzyl or mixtures thereof;

$R^2$ is a long chain $C_{10}$–$C_{22}$ hydrocarbyl, or substituted hydrocarbyl substituent, preferably $C_{15}$–$C_{19}$ alkyl and/or alkenyl, most preferably $C_{15}$–$C_{18}$ straight chain alkyl and/or alkenyl; and the counterion, $A^\theta$, can be any softener-compatible anion, or example, chloride, bromide, methylsulfate, formate, sulfate, nitrate and the like; and (vii) mixtures thereof.

Examples of Component I(b)(i) are the monoalkyltrimethylammonium salts such as monotallowtrimethylammonium chloride, mono (hydrogenated tallow) trimethylammonium chloride, palmityltrimethylammonium chloride and soyatrimethylammonium chloride, sold by Sherex Chemical Company under the trade name Adogen® 471, Adogen® 441, Adogen® 444, and Adogen® 415, respectively. In these salts, $R_4$ is an acyclic aliphatic $C_{16}$–$C_{18}$ hydrocarbon group, and $R_5$ and $R_6$ are methyl groups. Mono(hydrogenated tallow)trimethylammonium chloride and monotallowtrimethylammonium chloride are preferred. Other examples of Component I(b)(i) are behenyltrimethylammonium chloride wherein $R_4$ is a $C_{22}$ hydrocarbon group and sold under the trade name Kemamine® Q2803-C by Humko Chemical Division of Witco Chemical Corporation; soyadimethylethylammonium ethylsulfate wherein $R_4$ is a $C_{16}$–$C_{18}$ hydrocarbon group, $R_5$ is a methyl group, R6 is an ethyl group, and $A^\theta$ is an ethylsulfate anion, sold under the trade name Jordaquat® 1033 by Jordan Chemical Company; and methyl-bis(2-hydroxyethyl)-octadecylammonium chloride wherein $R_4$ is a $C_{18}$ hydrocarbon group, $R_5$ is a 2-hydroxyethyl group and $R_6$ is a methyl group and available under the trade name Ethoquad® 18/12 from Armak Company.

An example of Component I(b)(iii) is 1-ethyl-1-(2-hydroxyethyl)-2-isoheptadecylimidazolinium ethylsulfate wherein $R_1$ is a $C_{17}$ hydrocarbon group, $R_2$ is an ethylene group, $R_5$ is an ethyl group, and $A^{\theta\bar{O}}$ is an ethylsulfate anion. It is available from Mona Industries, Inc., under the trade name Monaquat® ISIES.

An example of Component I(b)(vi) is mono (tallowoyloxyethyl)hydroxyethyldimethylammonium chloride, i.e., monoester of tallow fatty acid with di(hydroxyethyl)dimethylammonium chloride, a by-product in the process of making diester of tallow fatty acid with di(hydroxyethyl)dimethylammonium chloride, i.e., di(tallowoyloxyethyl)dimethylammonium chloride, a I(c) (vii) component (vide infra).

Component I(c)

Preferred cationic nitrogenous salts having two or more long chain acyclic aliphatic $C_{15}$–$C_{22}$ hydrocarbon groups or one said group and an arylalkyl group which can be used either alone or as part of a mixture are selected from the group consisting of:

(i) acyclic quaternary ammonium salts having the formula:

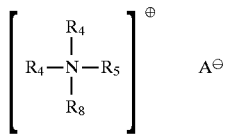

wherein $R_4$ is an acyclic aliphatic $C_{15}$–$C_{22}$ hydrocarbon group, $R_5$ is a $C_1$–$C_4$ saturated alkyl or hydroxyalkyl group, $R_8$ is selected from the group consisting of $R_4$ and $R_5$ groups, and $A^\theta$ is an anion defined as above;

(ii) diamido quaternary ammonium salts having the formula:

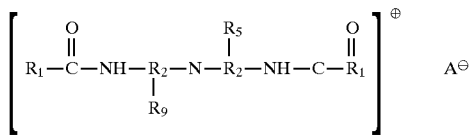

wherein $R_1$ is an acyclic aliphatic $C_{15}$–$C_{21}$ hydrocarbon group, $R_2$ is a divalent alkylene group having 1 to 3 carbon atoms, $R_5$ and $R_9$ are $C_1$–$C_4$ saturated alkyl or hydroxyalkyl groups, and $A^\theta$ is anion;

(iii) diamino alkoxylated quaternary ammonium salts having the formula:

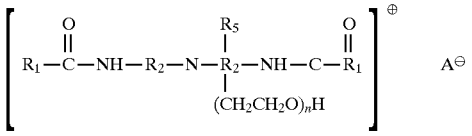

wherein n is equal to 1 to about 5, and $R_1$, $R_2$, $R_5$ and $A^\theta$ are as defined above;

(iv) quaternary ammonium compounds having the formula:

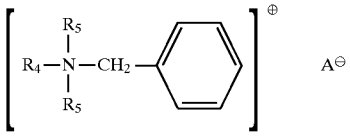

wherein $R_4$ is an acyclic aliphatic $C_{15}$–$C_{22}$ hydrocarbon group, $R_5$ is a $C_1$–$C_4$ saturated alkyl or hydroxyalkyl group, $A^\theta$ is an anion;

(v) substituted imidazolinium salts having the formula:

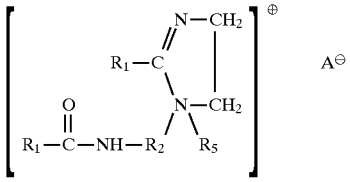

wherein $R_1$ is an acyclic aliphatic $C_{15}$–$C_{21}$ hydrocarbon group, $R_2$ is a divalent alkylene group having 1 to 3 carbon atoms, and $R_5$ and $A^\theta$ are as defined above; and (vi) substituted imidazolinium salts having the formula:

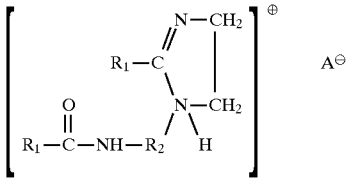

wherein $R_1$, $R_2$ and $A^\theta$ are as defined above;

(vii) diester quaternary ammonium (DEQA) compounds having the formula:

$(R)_{4-m}—N^{\oplus}—[(CH_2)_n—Y—R^2]_m\ A^\theta$ wherein each Y=—O—(O)C—, or —C(O)—O—;

m=2 or 3;

each n=1 to 4;

each R substituent is a short chain $C_1$–$C_6$, preferably $C_1$–$C_3$ alkyl or hydroxyalkyl group, e.g., methyl (most preferred), ethyl, propyl, hydroxyethyl, and the like, benzyl, or mixtures thereof;

each $R^2$ is a long chain $C_{10}$–$C_{22}$ hydrocarbyl, or substituted hydrocarbyl substituent, preferably $C_{15}$–$C_{19}$ alkyl and/or alkenyl, most preferably $C_{15}$–$C_{18}$ straight chain alkyl and/or alkenyl; and the counterion, $A^\theta$, can be any softener-compatible anion, for example, chloride, bromide, methylsulfate, formate, sulfate, nitrate and the like; and (viii) mixtures thereof.

Examples of Component I(c)(i) are the well known dialkyldimethylammonium salts such as ditallowdimethylammonium chloride, ditallowdimethylammonium methylsulfate, di(hydrogenated tallow)dimethylammonium chloride, distearyldimethylammonium chloride, dibehenyldimethylammonium chloride. Di(hydrogenated tallow) dimethylammonium chloride and ditallowdimethylammonium chloride are preferred. Examples of commercially available dialkyldimethylammonium salts usable in the present invention are di(hydrogenated tallow) dimethylammonium chloride (tradename Adogen® 442), ditallowdimethylammonium chloride (trade name Adogen® 470), distearyldimethylammonium chloride (trade name Arosurf® TA-100), all available from Sherex Chemical Company. Dibehenyldimethylammonium chloride wherein $R_4$ is an acyclic aliphatic $C_{22}$ hydrocarbon group is sold under the trade name Kemamine Q-2802C by Humko Chemical Division of Witco Chemical Corporation.

Examples of Component I(c)(ii) are methylbis (tallowamidoethyl)(2-hydroxyethyl)ammonium methylsulfate and methylbis(hydrogenated tallowamidoethyl)(2-hydroxyethyl)ammonium methylsulfate wherein $R_1$ is an acyclic aliphatic $C_{15}$–$C_{17}$ hydrocarbon group, $R_2$ is an ethylene group, $R_5$ is a methyl group, $R_9$ is a hydroxyalkyl group and $A^\theta$ is a methylsulfate anion; these materials are available from Sherex Chemical Company under the trade names Varisoft® 222 and Varisoft® 110, respectively.

An example of Component I(c)(iv) is dimethylstearylbenzylammonium chloride wherein $R_4$ is an acyclic aliphatic $C_{18}$ hydrocarbon group, $R_5$ is a methyl group and $A^\theta$ is a chloride anion, and is sold under the trade names Varisoft® SDC by Sherex Chemical Company and Ammonyx® 490 by Onyx Chemical Company.

Examples of Component I(c)(v) are 1-methyl-1-tallowamidoethyl-2-tallowimidazolinium methylsulfate and 1-methyl-1-(hydrogenated tallowamidoethyl)-2-(hydrogenated tallow)imidazolinium methylsulfate wherein $R_1$ is an acyclic aliphatic $C_{15}$–$C_{17}$ hydrocarbon group, $R_2$ is an ethylene group, $R_5$ is a methyl group and $A^\theta$ is a chloride anion; they are sold under the trade names Varisoft® 475 and Varisoft® 445, respectively, by Sherex Chemical Company.

It will be understood that for I(c)(vii) above substituents R and $R^2$ can optionally be substituted with various groups such as alkoxy or hydroxyl groups, and/or can be saturated, unsaturated, straight, and/or branched so long as the $R^2$ groups maintain their basically hydrophobic character. Preferred softening compounds are biodegradable such as those in Component I(c)(vii). These preferred compounds can be considered to be diester variations of ditallow dimethyl ammoniumchloride (DTDMAC), which is a widely used fabric softener.

The following are non-limiting examples of I(c)(vii) (wherein all long-chain alkyl substituents are straight-chain):

$[CH_3]_2{}^{\oplus}N[CH_2CH_2OC(O)R^2]\ \ Cl^{\ominus}$ $[HO-CH(CH_3)CH_2][CH_3]^{\oplus}N[CH_2CH_2OC(O)C_{15}H_{31}]_2\ \ Br^{\ominus}$ $[C_2H_5]_2{}^{\oplus}N[CH_2CH_2OC(O)C_{17}H_{35}]_2\ \ Cl^{\ominus}$ $[CH_3][C_2H_5]^{\oplus}N[CH_2CH_2OC(O)C_{13}H_{27}]_2\ \ I^{\ominus}$ $[C_3H_7][C_2H_5]^{\oplus}N[CH_2CH_2OC(O)C_{15}H_{31}]_2\ \ SO_4{}^{\ominus}CH_3$ $[CH_3]_2{}^{\oplus}N(CH_2CH_2OC(O)C_{17}H_{35})-CH_2CH_2OC(O)C_{15}H_{31}\ \ Cl^{\ominus}$ $[CH_2CH_2OH][CH_3]^{\oplus}N[CH_2CH_2OC(O)R^2]_2\ \ Cl^{\ominus}$ where—$C(O)R^2$ is derived from soft tallow and/or hardened tallow fatty acids. Especially preferred is diester of soft and/or hardened tallow fatty acids with di(hydroxyethyl) dimethylammonium chloride, also called di(tallowoyloxyethyl)dimethylammonium chloride.

Since the foregoing compounds (diesters) are somewhat labile to hydrolysis, they should be handled rather carefully when used to formulate the compositions herein. For example, stable liquid compositions herein are formulated at a pH in the range of about 2 to about 5, preferably from about 2 to about 4.5, more preferably from about 2 to about 4. The pH can be adjusted by the addition of a Bronsted acid. pH ranges for making stable softener compositions containing diester quaternary ammonium fabric softening compounds are disclosed in U.S. Pat. No. 4,767,547, Straathof and Konig, issued Aug. 30, 1988, and is incorporated herein by reference.

The diester quaternary ammonium fabric softening compound (DEQA) of I(c)(vii) can also have the general formula:

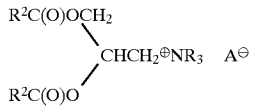

wherein each R, $R^2$, and $A^\theta$ have the same meanings as before. Such compounds include those having the formula:

$$[CH_3]_3\oplus N[CH_2CH(CH_2OC[O]R^2)OC(O)R^2]\ Cl^\theta$$

where $OC(O)R^2$ is derived from soft tallow and/or hardened tallow fatty acids.

Preferably each R is a methyl or ethyl group and preferably each $R^2$ is in the range of $C_{15}$ to $C_{19}$. Degrees of branching, substitution and/or non-saturation can be present in the alkyl chains. The anion $A^\theta$ in the molecule is preferably the anion of a strong acid and can be, for example, chloride, bromide, iodide, sulphate, and methyl sulphate; the anion can carry a double charge in which case $A^\theta$ represents half a group. These compounds, in general, are more difficult to formulate as stable concentrated liquid compositions.

These types of compounds and general methods of making them are disclosed in U.S. Pat. No. 4,137,180, Naik et al., issued Jan. 30, 1979, which is incorporated herein by reference.

A preferred composition contains Component I(a) at a level of from about 10% to about 80%, Component I(b) at a level of from about 3% to about 40%, and Component I(c) at a level of from about 10% to about 80%, by weight of said Component I. A more preferred composition contains Component I(c) which is selected from the group consisting of: (I) di(hydrogenated tallow)dimethylammonium chloride; (v) methyl-1-tallowamidoethyl-2-tallowimidazolinium methylsulfate; (vii) diethanol ester dimethylammonium chloride; and mixtures thereof.

An even more preferred composition contains Component I(a): the reaction product of about 2 moles of hydrogenated tallow fatty acids with about 1 mole of N-2--hydroxyethylethylenediamine and is present at a level of from about 20% to about 70% by weight of Component I; Component I(b): mono(hydrogenated tallow)trimethylammonium chloride present at a level of from about 3% to about 30% by weight of Component I; Component I(c): selected from the group consisting of di(hydrogenated tallow)dimethylammonium chloride, ditallowdimethylammonium chloride, methyl-1-tallowamidoethyl-2-tallowimidazolinium methylsulfate, diethanol ester dimethylammonium chloride, and mixtures thereof; wherein Component I(c) is present at a level of from about 20% to about 60% by eight of Component I; and wherein the weight ratio of said di(hydrogenated tallow) dimethylammonium chloride to said methyl-1-tallowamidoethyl-2-tallowimidazolinium methylsulfate is from about 2:1 to about 6:1.

The above individual components can also be used individually, especially those of I(c)(e.g., ditallowdimethylammonium chloride or diethanol ester dimethylammonium chloride).

Anion $A^\theta$

In the cationic nitrogenous salts herein, the anion $A^\theta$ provides charge neutrality. Most often, the anion used to provide charge neutrality in these salts is a halide, such as fluoride, chloride, bromide, or iodide. However, other anions can be used, such as methylsulfate, ethylsulfate, hydroxide, acetate, formate, sulfate, carbonate, and the like. Chloride and methylsulfate are preferred herein as anion $A^\theta$.

II. Polymeric Dye Transfer Inhibiting Agents

The composition of the present invention contains an effective amount of polymeric dye transfer inhibiting agent (dye transfer inhibitor or DTI) or mixtures thereof. An effective amount is typically an amount of DTI which will provide at least about 0.1 ppm, preferably from about 0.1 ppm to about 2,000 ppm, more preferably from about 0.2 ppm to about 1,000 ppm, in the wash or rinse solution. Preferably, the present invention contains from about 0.03% to about 25% of dye transfer inhibitor, more preferably from about 0.1% to about 15%, and even more preferably from about 0.2% to about 10% for concentrated liquid softener compositions, and from about 0.01% to about 8% for compositions with softener active of less than about 9%.

Dye transfer inhibitors useful in the present invention include water-soluble polymers. This polymer has dye complexing properties, particularly dye transfer inhibitor properties, for use in laundry applications, having the formula:

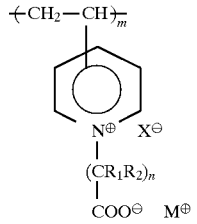

where m is indicative of the degree of polymerization;

X is an anion;

$R_1$ and $R_2$ are independently hydrogen, alkyl or aryl;

n is 1–5; and

M is a cation.

Preferred embodiments of the invention are polymers in which X is a halide; most preferably chloride or bromide; $R_1$ and $R_2$ are both hydrogen; n is 1; M is an alkali metal; preferably sodium or potassium; and the polymer is 25–100% quaternized; most preferably 75–100%.

A preferred polymer has a weight average molecular weight of about 5,000 to 1,000,000; preferably 20,000 to 200,000, where m is about 30–5000, preferably 100–1000. Water soluble copolymers of the defined polymer above with polymerizable monomers, such as vinyl pyrrolidone, vinyl caprolactam, vinyl imidazole, n-vinyl formamide, and acrylamide, and mixtures thereof also are useful herein.

In a preferred embodiment of the invention, the water soluble polymers of the invention are made by polymerizing a vinylpyridine under suitable polymerization conditions to form a poly(vinylpyridine) intermediate, and then reacting the intermediate polymer with sodium chloroacetate in an aqueous medium. The reaction product is a poly (vinylpyridine betaine) polymer containing a quaternary nitrogen and a carboxylate salt.

In the polymerization step, which may be solution, precipitation or emulsion polymerization, any suitable solvent may be used, for example, an alcohol, such as methanol, ethanol or isopropanol; water; or mixtures of water and alcohol. The reaction temperature is about 40° to 150° C, preferably 50° to 90° C., and most preferably about 60° to 85° C. The polymerization initiator is a free radical initiator, such as perester, peroxide, percarbonate, or Vazo® type initiators may be used. The polymerization is carried out at a solids level of about 5 to 80%, preferably 20 to 50%.

A preferred polymer* made herein is poly(4-vinylpyridine)sodium carboxymethyl betaine chloride having the formula:

*POLYMER A

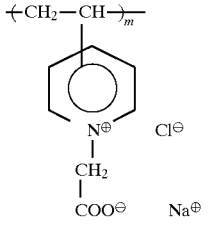

III. Liquid Carriers

The liquid carrier is typically selected from the group consisting of water, $C_1$–$C_4$ monohydric alcohols, $C_2$–$C_6$ polyhydric alcohols (e.g., alkyleneglycols like propylene glycol), liquid plyalkylene glycols such as polyethylene glycol with an average molecular weight of about 200, and mixtures thereof. Water, a preferred carrier, may be distilled, deionized, or tap water.

IV. Optional Ingredients

A. Polymeric Soil Release Agents

Soil release agents, usually polymers, are especially desirable additives at levels of from about 0.05% to about 5%, preferably from about 0.1% to about 4%, more preferably from about 0.2% to about 3%. Suitable soil release agents are disclosed in U.S. Pat. No.: 4,702,857, Gosselink, issued Oct. 27, 1987; U.S. Pat. No. 4,711,730, Gosselink and Diehl, issued Dec. 8, 1987; U.S. Pat. No. 4,713,194, Gosselink issued Dec. 15, 1987; U.S. Pat. No. 4,877,896, Maldonado, Trinh, and Gosselink, issued Oct. 31, 1989; U.S. Pat. No. 4,956,447, Gosselink, Hardy, and Trinh, issued Sep. 11, 1990; and U.S. Pat. No. 4,749,596, Evans, Huntington, Stewart, Wolf, and Zimmerer, issued Jun. 7, 1988, said patents being incorporated herein by reference.

Especially desirable optional ingredients are polymeric soil release agents comprising block copolymers of polyalkylene terephthalate and polyoxyethylene terephthalate, and block copolymers of polyalkylene terephthalate and polyethylene glycol. The polyalkylene terephthalate blocks preferably comprise ethylene and/or propylene groups. Many such soil release polymers are nonionic.

A preferred nonionic soil release polymer has the following average structure.

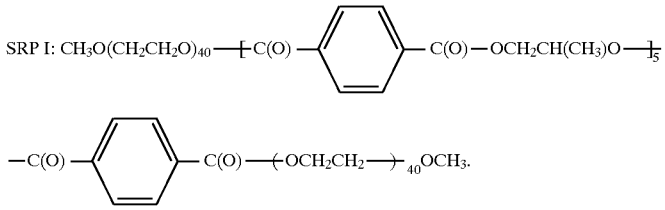

Such soil release polymers are described in U.S. Pat. No. 4,849,257, Borcher, Trinh and Bolich, issued Jul. 18, 1989, said patent being incorporated herein by reference.

Another highly preferred nonionic soil release polymer is described in WO92/17523 published 15 Oct. 1992.

The polymeric soil release agents useful in the present invention can include anionic and cationic polymeric soil release agents. Suitable anionic polymeric or oligomeric soil release agents are disclosed in U.S. Pat. No. 4,018,569, Trinh, Gosselink and Rattinger, issued Apr. 4, 1989, said patent being incorporated herein by reference. Other suitable polymers are disclosed in U.S. Pat. No. 4,808,086, Evans, Huntington, Stewart, Wolf, and Zimmerer, issued Feb. 24, 1989, said patent being incorporated herein by reference. Suitable cationic soil release polymers are described in U.S. Pat. No. 4,956,447, Gosselink, Hardy, and Trinh, issued Sep. 11, 1990, said patent being incorporated hereinbefore by reference.

B. Other Optional Ingredients

A preferred optional ingredient is perfume. Such perfume is preferably present at a level of from about 0.01% to about 5%, preferably from about 0.05% to about 3%, more preferably from about 0.1% to about 2%, by weight of the total composition.

Other adjuvants can be added to the compositions herein for their known purposes. Such adjuvants include, but are not limited to, viscosity control agents, emulsifiers, preservatives, antioxidants, bacteriocides, fungicides, brighteners, opacifiers, freeze-thaw control agents, shrinkage control agents, and agents to provide ease of ironing. These adjuvants, if used, are added at their usual levels, generally each at up to about 5% by weight of the composition.

Viscosity control agents can be organic or inorganic in nature. Examples of organic viscosity modifiers (lowering) are aryl carboxylates and sulfonates (e.g., benzoate, 2-hydroxybenzoate, 2-aminobenzoate, benzenesulfonate, 2-hydroxybenzenesulfonate, 2-aminobenzenesulfonate, etc.), fatty acids and esters, fatty alcohols, and water-miscible solvents such as short chain alcohols. Examples of inorganic viscosity control agents are water-soluble ionizable salts. A wide variety of ionizable salts can be used.

Examples of suitable salts are the halides of the group IA and IIA metals of the Periodic Table of the Elements, e.g., calcium chloride, magnesium chloride, sodium chloride, potassium bromide, and lithium chloride. Calcium chloride is preferred. The ionizable salts are particularly useful during the process of mixing the ingredients to make the compositions herein, and later to obtain the desired viscosity. The amount of ionizable salts used depends on the amount of active ingredients used in the compositions and can be adjusted according to the desire of the formulator. Typical levels of salts used to control the composition viscosity are from 0 to about 10,000 parts per million (ppm), preferably from about 10 to about 6,000 ppm by weight of the composition.

Viscosity modifiers (raising) can be added to increase the ability of the compositions to stably suspend water-insoluble particles, e.g., perfume microcapsules. Such materials include hydroxypropyl substituted guar gum (e.g., Jaguar® HP200, available from Rhone-Poulenc), polyethylene glycol (e.g., Carbowax 20M from Union Carbide), hydrophobic modified hydroxyethylcellulose (e.g., Natrosol Plus® from Aqualon), and/or organophilic clays (e.g., Hectorite and/or Bentonite clays such as Bentones® 27, 34 and 38 from Rheox Co.). These viscosity raisers (thickeners) are typically used at levels from about 500 ppm to about 30,000 ppm, preferably from about 1,000 ppm to about 5,000 ppm, more preferably from about 1,500 ppm to about 3,500 ppm.

Examples of bacteriocides useful in the compositions of this invention are glutaraldehyde, formaldehyde, 2-bromo-2-nitropropane-1,3-diol sold by Inolex Chemicals under the trade name Bronopol®, and a mixture of 5-chloro-2-methyl-4-isothiazoline-3-one and 2-methyl-4-isothiazoline-3-one sold by Rohm and Haas Company under the trade name Kathon® CG/ICP. Typical levels of bactericides used in the present compositions are from about 1 to about 1,000 ppm by weight of the composition.

Examples of antioxidants that can be added to the compositions of this invention are propyl gallate, available from Eastman Chemical Products, Inc., under the trade names Tenox® PG and Tenox S-1, and dibutylated hydroxy toluene, available from UOP Process Division under the trade name Sustane® BHT.

The present compositions can contain silicones to provide additional benefits such as ease of ironing and improved fabric absorbency. The preferred silicones are polydimethylsiloxanes of viscosity of from about 100 centistokes (cs) to about 100,000 cs, preferably from about 200 cs to about 60,000 cs and/or silicone gums. These silicones can be used in emulsified form, which can be conveniently obtained directly from the suppliers. Examples of these preemulsified silicones are 60% emulsion of polydimethylsiloxane (350 cs) sold by Dow Corning Corporation under the trade name DOW CORNING® 1157 Fluid and 50% emulsion of polydimethylsiloxane (10,000 cs) sold by General Electric Company under the trade name General Electric® SM 2140 Silicones. Microemulsions are preferred, especially when the composition contains a dye. The optional silicone component can be used in an amount of from about 0.1% to about 6% by weight of the composition.

Silicone foam suppressants can also be used. These are usually not emulsified and typically have viscosities of from about 100 cs to about 10,000 cs, preferably from about 200 cs to about 5,000 cs. Very low levels are used, typically from about 0.01% to about 1%, preferably from about 0.02% to about 0.5%. Another preferred foam suppressant is a silicone/silicate mixture, e.g., Dow Corning's Antifoam A®.

Any dye can be used in the compositions of the present invention, but nonionic dyes are preferred to decrease interaction with dye transfer inhibitor. Useful acid dyes include: Polar Brilliant Blue, and D&C Yellow $10, both supplied by Hilton Davis, Cincinnati, Ohio. Nonionic Liquitint® dyes supplied by Milliken, Spartanburg, S.C., are also useful. Especially preferred Liauitint dyes are selected from the group consisting of: Blue HP, Blue 65, Experimental Yellow 8949043, Green HMC, Patent Blue, Royal Blue, Teal, Violet, Yellow II, and mixtures thereof.

A preferred composition contains from 0% to about 3% of polydimethylsiloxane, from 0% to about 0.4% of $CaCl_2$, and from about 10 ppm to about 100 ppm of dye.

The pH (10% solution) of the compositions of this invention is generally adjusted to be in the range of from about 2 to about 7, preferably from about 2.4 to about 6.5, more preferably from about 2.6 to about 4. Adjustment of pH is normally carried out by including a small quantity of free acid in the formulation. Because no strong pH buffers are present, only small amounts of acid are required. Any acidic material can be used; its selection can be made by anyone skilled in the softener arts on the basis of cost, availability, safety, etc. Among the acids that can be used are methyl sulfonic, hydrochloric, sulfuric, phosphoric, citric, maleic, and succinic. For the purposes of this invention, pH is measured by a glass electrode in a 10% solution in water of the softening composition in comparison with a standard calomel reference electrode.

V. Process of Making Liquid Compositions

The liquid fabric softening compositions of the present invention can be prepared by the following methods. A convenient and satisfactory method is to prepare a softening active melt premix (active premix) at from about 100° F. (about 38° C.) to about 190° F. (about 88° C.), which is then added with high shear mixing with milling to the hot water seat at from about 100° F. (about 38° C.) to about 190° F. (about 88° C.). The dye transfer inhibitor can be added to the water seat, prior to the beginning of the premix transfer, either as a powder or as an aqueous solution. Temperature-sensitive optional components can be added after the fabric softening composition is cooled to a lower temperature. Preferably the liquid softener compositions of the present invention are made by a process comprising the following steps:

(a) Melting and mixing softener active;

(b) Adding the dye transfer inhibitor to the water seat, having a temperature from about 100° F. (about 38° C.) to about 190° F. (about 88° C.);

(c) Adding the mixture of (a) into the water seat with agitation;

(d) Optionally adding a viscosity control agent (e.g., $CaCl_2$); and (e) Cooling the composition.

The dye transfer inhibitor can also be added upon cooling of the composition, during or after Step (e), or into the water seat after premix addition is complete, i.e., after Step (c) but before Step (d).

Surprisingly, adding the dye transfer inhibitor into the water seat prior to premix addition results in products having a better dye transfer inhibition than products with dye transfer inhibitor added after premix addition and cooling.

The liquid fabric softening composition of this invention are used by adding to the rinse cycle of conventional home laundry operations. Generally, rinse water has a temperature of from about 5° C. to about 50° C., more frequently from about 10° C. to about 40° C. The concentration of the fabric softener actives of this invention is generally from about 10 ppm to about 200 ppm, preferably from about 25 ppm to about 100 ppm, by weight of the aqueous rinsing bath. The concentration of the dye transfer inhibitor is generally from about 0.3 ppm to about 500 ppm, more preferably from about 1 ppm to about 300 ppm in the rinse solution.

In general, the present invention in its fabric softening method aspect comprises the steps of (1) washing fabrics in a conventional washing machine or hand washing with a detergent composition; and (2) rinsing the fabrics in a bath which contains the above described amounts of the fabric softeners; (3) drying the fabrics in an automatic laundry dryer or line drying; and (4) subsequent washing of fabrics in a conventional washing machine or hand washing with a detergent composition. When multiple rinses are used, the fabric softening composition is preferably added to the final rinse.

DRYER-ADDED FABRIC SOFTENING COMPOSITIONS

The present invention also relates to dryer-added fabric conditioning (softening) compositions and articles of manufacture in which the fabric conditioning (softening) compositions are affixed to a dispensing means, e.g., a substrate.

In preferred embodiments, the present invention encompasses articles of manufacture, adapted for use to provide unique dye transfer inhibition benefits and to soften fabrics in an automatic laundry dryer, of the types disclosed in U.S. Pat. No: 3,989,631, Marsan, issued Nov. 2, 1976; U.S. Pat. No. 4,055,248, Marsan, issued Oct. 25, 1977; U.S. Pat. No. 4,073,996, Bedenk et al., issued Feb. 14, 1978; U.S. Pat. No. 4,022,938, Zaki et al., issued Jul. 25, 1978; U.S. Pat. No. 3,736,668, Dillarstone, issued Jun. 5, 1973; issued Jun. 5, 1973; U.S. Pat. No. 3,701,202, Compa et al., issued Oct. 31, 1972; U.S. Pat. No. 3,634,947, Furgal, issued Jan. 18, 1972; U.S. Pat. No. 3,633,538, Hoeflin, issued Jan. 11, 1972; and U.S. Pat. No. 3,435,537, Rumsey, issued Apr. 1, 1969; and U.S. Pat. No. 4,000,340, Murphy et al., issued Dec. 28, 1976, all of said patents being incorporated herein by reference.

Typical articles of manufacture of this type include articles comprising:

1. a fabric conditioning composition comprising:
   - I. an effective amount, preferably from abut 50% to about 99%, more preferably from about 70% to about 99%, of fabric softening agent;
   - II. an effective amount, preferably from about 0.2% to about 50%, more preferably from about 1% to about 30%, of polymeric dye transfer inhibiting agent; and
   - III. optionally, a dispensing means which provides for release of an effective amount of said composition to fabrics in an automatic laundry dryer at automatic laundry dryer operating temperatures, e.g., from about 35° C. to 115° C.

When the dispensing means is a flexible substrate, e.g., in sheet configuration, the fabric conditioning composition is releasably affixed on the substrate to provide a weight ratio of conditioning composition to dry substrate ranging from about 10:1 to about 0.5:1, preferably from about 5:1 to about 1:1.

The term "fabric softening agent" as used herein includes cationic and nonionic fabric softeners used alone and also in combination with each other. A preferred fabric softening agent of the present invention is a mixture of cationic and nonionic fabric softeners. An effective amount of dye transfer inhibitor is an amount which will provide from about 0.1 ppm to about 500 ppm of DTI in the wash solution.

I. Fabric Softening Agents

Examples of fabric softening agents that are especially useful in the substrate articles are the compositions described in U.S. Pat. No. : 4,103,047, Zaki et al., issued Jul. 25, 1978; U.S. Pat. No. 4,237,155, Kardouche, issued Dec. 2, 1980; U.S. Pat. No. 3,686,025, Morton, issued Aug. 22, 1972; U.S. Pat. No. 3,849,435, Diery et al., issued Nov. 19, 1974; and U.S. Pat. No. 4,073,996, Bedenk et al., issued Feb. 14, 1978; said patents are hereby incorporated herein by reference. Other fabric softening agents are disclosed hereinafter with respect to detergent-compatible fabric conditioning compositions.

Particularly preferred cationic fabric softeners for substrate articles include quaternary ammonium salts such as dialkyl dimethylammonium chlorides, methylsulfates, and ethylsulfates wherein the alkyl groups can be the same or different and contain from about 14 to about 22 carbon atoms. Examples of such preferred materials include ditallowalkyldimethylammonium methylsulfate (DTDMAMS), distearyldimethylammonium methylsulfate, dipalmityldimethylammonium methylsulfate and dibehenyldimethylammonium methylsulfate. Also particularly preferred are the carboxylic acid salts of tertiary alkylamines disclosed in said Kardouche patent. Examples include stearyldimethylammonium stearate, distearylmethylammonium myristate, stearyldimethylammonium palmitate, distearylmethylammonium palmitate, and distearylmethylammonium laurate. These carboxylic salts can be made in situ by mixing the corresponding amine and carboxylic acid in the molten fabric conditioning composition.

Other preferred types of fabric softener are described in detail in U.S. Pat. No. 4,661,269, Toan Trinh, Errol H. Wahl, Donald M. Swartley, and Ronald L. Hemingway, issued Apr. 28, 1987, said patent being incorporated hereinbefore by reference.

Examples of nonionic fabric softeners are the sorbitan esters, $C_{12}$–$C_{26}$ fatty alcohols, and fatty amines described herein.

A preferred fabric softening agent for use in substrate articles comprises a mixture of (1) $C_{10}$–$C_{26}$ acyl sorbitan esters and mixtures thereof, (2) quaternary ammonium salt, and (3) tertiary alkylamine. The quaternary ammonium salt is preferably present at a level of from about 5% to about 25%, more preferably from about 7% to about 20% of the fabric conditioning composition. The sorbitan ester is preferably present at a level of from about 10% to about 50%, more preferably from about 20% to about 40%, by weight of the fabric conditioning composition. The tertiary alkylamine is present at a level of from about 5% to about 25%, more preferably from 7% to about 20% by weight of the fabric conditioning composition. The preferred sorbitan ester comprises a member selected from the group consisting of $C_{10}$–$C_{26}$ acyl sorbitan monoesters and $C_{10}$–$C_{26}$ acyl sorbitan di-esters, and ethoxylates of said esters wherein one or more of the unesterified hydroxyl groups in said esters contain from 1 to about 6 oxyethylene units, and mixtures thereof. The quaternary ammonium salt is preferably in the methylsulfate form. The preferred tertiary alkylamine is selected from the group consisting of alkyldimethylamine and dialkylmethylamine and mixtures thereof, wherein the alkyl groups can be the same or different and contain from about 14 to about 22 carbon atoms.

Yet another preferred fabric softening agent comprises a carboxylic acid salt of a tertiary alkylamine, in combination with a fatty alcohol and a quaternary ammonium salt. The carboxylic acid salt of a tertiary amine is used in the fabric conditioning composition preferably at a level of from about 5% to about 50%, and more preferably, from about 15% to about 35%, by weight of the fabric treatment composition. The quaternary ammonium salt is used preferably at a level of from about 5% to about 25%, and more preferably, from about 7% to about 20%, by weight of the fabric treatment composition. The fatty alcohol can be used preferably at a level of from about 10% to about 25%, and more preferably from about 10% to about 20%, by weight of the fabric treatment composition. The preferred quaternary ammonium salt is selected from the group consisting of dialkyl dimethylammonium salt wherein the alkyl groups can be the same or different and contain from about 14 to about 22 carbon atoms and wherein the counteranion is selected from the group consisting of chloride, methylsulfate and ethylsulfate, preferably methylsulfate. The preferred carboxylic acid salt of a tertiary alkylamine is selected from the group consisting of fatty acid salts of alkyldimethylamines wherein the alkyl group contains from abut 14 to about 22 carbon atoms, and the fatty acid contains from about 14 to about 22 carbon atoms, and mixtures thereof. The preferred fatty alcohol contains from about 14 to about 22 carbon atoms.

More biodegradable fabric softener compounds can be desirable. Biodegradability can be increased, e.g., by incorporating easily destroyed linkages into hydrophobic groups. Such linkages include ester linkages, amide linkages, and linkages containing unsaturation and/or hydroxy groups. Examples of such fabric softeners can be found in U.S. Pat. No. : 3,408,361, Mannheimer, issued Oct. 29, 1968; U.S. Pat. No. 4,709,045, Kubo et al., issued Nov. 24, 1987; U.S. Pat. No. 4,233,451, Pracht et al., issued Nov. 11, 1980; U.S. Pat. No. 4,127,489, Pracht et al., issued Nov. 28, 1979; U.S. Pat. No. 3,689,424, Berg et al., issued Sep. 5, 1972; U.S. Pat. No. 4,128,485, Baumann et al., issued Dec. 5, 1978; U.S. Pat. No. 4,161,604, Elster et al., issued Jul. 17, 1979; U.S. Pat. No. 4,189,593, Wechsler et al., issued Feb. 19, 1980; and U.S. Pat. No. 4,339,391, Hoffman et al., issued Jul. 13, 1982, said patents being incorporated herein by reference.

II. Polymeric Dye Transfer Inhibiting Agents

Dye transfer inhibiting agents useful for dryer-added fabric softening compositions and articles of the present invention are those described earlier for rinse-added fabric softening compositions. Preferred are solid materials having particle size of about 1 mm or smaller, more preferably about 0.5 mm or smaller, most preferably about 0.2 mm or smaller.

When the dye transfer inhibiting agent has a larger particle size, the particle size can be conveniently reduced by grinding techniques followed by an appropriate particle size sorting method, e.g., sieving.

It is desirable, for ease of application, to intimately admix the ingredients of the fabric softening composition before application to a substrate dispensing means.

III. Optional Dispensing Means

In the preferred substrate article embodiment, the fabric conditioning compositions are provided as an article of manufacture in combination with a dispensing means such as a flexible substrate which effectively releases the composition in an automatic laundry (clothes) dryer. Such dispensing means can be designed for single usage or for multiple uses. The dispensing means can also be a "vanishing substrate material" that releases the fabric conditioning composition and then is dispersed and/or exhausted from the dryer.

The dispensing means will normally carry an effective amount of fabric conditioning composition. Such effective amount typically provides sufficient fabric softening agent and dye transfer inhibitor for at least one treatment of a minimum load in an automatic laundry dryer. Amounts of fabric conditioning composition for multiple uses, e.g., up to about 30, can be used. Typical amounts for a single article can vary from about 0.25 g to about 100 g, preferably from about 0.5 g to about 10 g, most preferably from about 1 g to about 5 g.

A highly preferred article herein comprises the fabric conditioning composition releasably affixed to a flexible substrate in a sheet configuration. Highly preferred paper, woven or nonwoven "absorbent" substrates useful herein are fully disclosed in U.S. Pat. No. 3,686,05, Morton, issued Aug. 22, 1972, incorporated herein by reference.

Nonwoven cloth substrates preferably comprise cellulosic fibers having a length of from about 3/16 inch to about 2 inches and a denier of from about 1.5 to about 5 and the substrates are adhesively bonded together with binder resin.

The flexible substrate preferably has openings sufficient in size and number to reduce restriction by said article of the flow of air through an automatic laundry dryer. The better openings comprise a plurality of rectilinear slits extended along one dimension of the substrate.

The substrate embodiment of this invention can be used for imparting the above-described fabric conditioning composition to fabric to provide dye transfer inhibition and/or softening and/or antistatic effects to fabric in an automatic laundry dryer in a process comprising: commingling pieces of damp fabric by tumbling said fabric under heat in an automatic clothes dryer with an effective amount of the fabric conditioning composition, at least the continuous phase of said composition having a melting point greater than about 35° C. and said composition being mobilized, e.g., flowable, at dryer operating temperature, said composition comprising from about 0.2% to about 50%, preferably from about 1% to about 30% of a dye transfer inhibitor powder, and from about 50% to about 99%, preferably from about 70% to about 99%, of fabric softening agent selected from the above-defined cationic and nonionic fabric softeners and mixtures thereof.

The method herein is carried out in the following manner. Damp fabrics, usually containing from about 1 to about 3.5 times their weight of water, are placed in the drum of an automatic laundry (clothes) dryer. In practice, such damp fabrics are commonly obtained by laundering, rinsing, and spin-drying the fabrics in a standard washing machine. In a preferred mode, the present process is carried out by fashioning an article comprising the substrate-like dispensing means for the type hereinabove described in releasable combination with a fabric conditioning composition. This article is simply added to a clothes dryer together with the damp fabrics to be treated. The dryer is then operated in standard fashion to dry the fabrics, usually at a temperature of from about 50° C. to about 80° C. for a period from about 10 minutes to about 60 minutes, depending on the fabric load and type. On removal from the dryer, the dried fabrics have acquired treatment with dye transfer inhibitor and are softened. It is believed that the dye transfer inhibitor deposited on the fabric is resolubilized in the subsequent wash solution to provide a noticeable dye transfer inhibition effect.

IV. Optional Ingredients

A. Viscosity Control Agents

Very useful ingredients are viscosity control agents, especially particulate clays, which are especially useful in the substrate articles. Examples of the particulate clays useful in the present invention are described in U.S. Pat. No. 4,103,047, supra, which is incorporated herein by reference. A preferred clay viscosity control agent is calcium bentonite clay, available from Southern Clay Products under the trade name Bentolite® L. The clay viscosity control agent is preferably present at a level of from about 0.5% to about 15%, more preferably from about 1.5% to about 10% by weight of the fabric conditioning composition.

B. Other Optional Ingredients

Well known optional components included in the fabric conditioning composition which are useful in the present invention are narrated in U.S. Pat. No. 4,103,047, supra, incorporated hereinbefore by reference.

A preferred optional ingredient is perfume/cyclodextrin inclusion complex present in the fabric conditioning composition at from about 0.5% to about 50%, preferably from about 1% to about 45%, more preferably from about 5% to about 40%. See U.S. Pat. No. 5,094,761, Trinh, Gardlik, Banks, and Benvegnu, issued Mar. 10, 1992; and U.S. Pat. No. 5,102,564, Gardlik, Trinh, Banks, and Benvegnu, issued Apr. 7, 1992, which are incorporated herein by reference.

Another preferred optional ingredient is free perfume, other than the perfume which is present as the perfume/cyclodextrin inclusion complex, which is also very useful for imparting odor benefits, especially in the product and/or in the dryer. Preferably, such free perfume contains at least about 1%, more preferably at least about 10% by weight of said free perfume, of substantive perfume materials. Such free perfume is preferably present at a level of from about 0.10% to about 10% by weight of the portion of the composition that is transferred to the fabrics, e.g., everything but the dispensing means in substrate articles.

Other preferred optional ingredients are polymeric soil release agents, described in Section IV.A above of liquid compositions. Preferably, these polymeric soil release agents contain one, or more, negatively charged functional groups such as the sulfonate functional group, preferably as capping groups at the terminal ends of said polymeric soil release agent. The soil release agent is preferably present at a level of from about 1to about 50%, more preferably from about 5% to about 45%, and most preferably from about 10% to about 40%, by weight of the fabric conditioning composition.

The polymeric soil release agents preferably become molten at temperatures no higher than about 90° C. and have viscosities of less than about 10,000 cps at 85° C. Other polymeric soil release agents with higher viscosities can be used when they are mixed with a viscosity reducing agent. Examples of some viscosity reducing agents for polymeric soil release agents, useful for the present invention, are given in U.S. Pat. No. 4,863,619, issued Sep. 5, 1989; U.S. Pat. No. 4,925,577, issued May 15, 1990; U.S. Pat. No. 5,041,230, issued Aug. 20, 1991, to Borcher, Delgado, and Trinh; these patents are incorporated herein by reference.

The articles of manufacture disclosed hereinbefore can impart noticeable dye transfer inhibition benefits plus softening and/or antistatic effects to fabrics when used in an automatic laundry dryer.

SOLID, PARTICULATE FABRIC SOFTENER COMPOSITIONS

Solid, particulate fabric softening compositions of the present invention typically comprise:

I. an effective amount, preferably from about 20% to about 90%, more preferably from about 30% to about 70%, of fabric softening agent; and II. an effective amount, preferably from about 0.1% to about 80%, more preferably from about 0.3% to about 50%, and even more preferably from about 0.5% to about 25%, of dye transfer inhibiting agent.

An effective amount of DTI is an amount which will provide from about 0.1 ppm to about 500 ppm of DTI in the rinse solution.

Optional, but preferred, ingredients include dispersing agents and perfumes. Preferred dispersing agents are cationic surfactants such as $C_2$–$C_{18}$ alkyl trimethylammonium halide, choline ester of fatty acids, etc. Such dispersing agents are present at a level of from 0 to about 45%, preferably from about 1% to about 30%.

Particulate fabric softener compositions for addition in the wash or rinse cycles of an automatic laundering operation have been described in, e.g., U.S. Pat. No. 3,256,180, Weiss, issued Jun. 14, 1966; U.S. Pat. No. 3,351,483, Miner et al., issued Nov. 7, 1967; U.S. Pat. No. 4,308,151, Cambre, issued Dec. 29, 1981; U.S. Pat. No. 4,589,989, Muller et al., issued May 20, 1986; and U.S. Pat. No. 5,009,800, Foster, issued Apr. 23, 1991; and foreign patent applications: Jap. Laid Open Appln. No. 8799/84, laid open Jan. 18, 1984; Jap. Appln. No. J62253698-A, Nov. 5, 1987; Jap. Laid Open Appln. No. 1-213476, laid open Aug. 28, 1989; Can. Appln. No. CA12328190A, Feb. 16, 1988; Jap. Appln. No. J63138000-A, Jun. 9, 1988; and European Appln. No. EP-289313-A, Nov. 2, 1988, all of said patents being incorporated herein by reference. A granular fabric softener composition which can be used to prepare a liquid composition.

COMPOSITIONAL ADVANTAGES OF THE PRESENT INVENTION

Preferably the softener compositions of the present invention are substantially, preferably, essentially free of aerosol propellants; bleach (especially activated bleach); sachets containing active ingredient; and anionic surfactants. The liquid softener compositions are, in addition, essentially free of large amounts (more than two times the amount of polymeric DTI) of highly ethoxylated and/or propoxylated materials (more than about eight ethoxylated and/or propoxylated units) when the fabric softening agent is methyl-1-oleylamidoethyl-2-oleylimidazolinium methosulfate, or analogous agent. The dryer-added compositions are also essentially free of polymer-coated soil release polymers.

The present invention, especially in the fabric softener aspect, can provide improved DTI benefits after multiple laundry operations. In addition, the invention can improve the appearance of fabrics that have previously been stained by dye transfer. Even after dyes deposit and discolor fabric, the polymeric DTI will help remove this dye from fabrics, especially, e.g., in fabric softener compositions, when used in multiple cycles. Also, the invention can provide a soil anti-redeposition benefit in the wash cycle.

The present invention also relates to a laundry method of minimizing dye transfer during the wash cycle of a laundering process by providing an effective amount of dye transfer inhibitor into the wash solution by means other than by adding it as part of a detergent composition. For example, DTI can be added to the wash solution as a powder, an aqueous solution, via a dispensing means (e.g., substrate) which will prevent powder inhalation, etc.

The invention also encompasses a laundry process (method) for imparting dye transfer inhibition plus softening and/or antistatic effects to fabrics comprising: washing a load of fabrics in a wash solution containing a detergent composition; rinsing said load of fabrics with a composition comprising an effective amount of softening active and an effective amount of dye transfer inhibitor and/or tumbling the load of fabrics under heat in the dryer with a dryer-added softener composition comprising an effective amount of dye transfer inhibitor; and subsequently washing all or part of said load of fabrics, together with or without additional fabrics, during which the dye transfer inhibitor is effectively released into the wash solution containing a detergent composition. A load of fabrics includes one or more fabric articles.

The following are nonlimiting examples of the invention.

EXAMPLE 1

A 1-liter, 4-necked resin kettle was fitted with an anchor agitator, a nitrogen purge adaptor, a thermometer, two subsurface feeding tubes connected with two feeding pumps, and a reflux condenser. The kettle was charged with 150 g of 4-vinylpyridine and 150 g of isopropanol. Nitrogen purging was started and continued throughout the process as was agitation at 200 rpm. Then the reactants were heated to 80° C. in 20 minutes and held at that for 30 minutes. Then 390 microliter of t-butyl peroxypivalate (Lupersol® 11) was charged. The solution polymerization reaction was carried out at 80° C. for 2 hours. Then a 195 microliter portion of Lupersol® 11 was added and reaction continued at 80° C. for another two hours. The latter step was repeated another 6 times. Then 150 g water and 166.2 g of sodium chloroacetate was charged and the contents were rinsed with 100 g of water. The resultant mixture was heated to remove 100 g of distillate then 100 g of water was added to the mixture; the step was repeated and yet another 50 g of distillate was removed. Then the mixture was cooled to room temperature. The product was obtained as a solution whose solids level was adjusted to about 48%.

EXAMPLE 2

The process of Example 1 was repeated using 125 g of sodium chloroacetate. A similar product was obtained.

EXAMPLE 3

The process of Example 1 was repeated using 83 g of sodium chloroacetate. A similar product was obtained.

EXAMPLE 4

A 1l, 4-necked resin kettle, fitted with an anchor agitator, a nitrogen purge adaptor, a thermometer and a reflux condenser, was charged with 50 g of 4-vinylpyridine, 50 g of vinylpyrrolidone and 150 g of isopropanol. Nitrogen purging was started and continued throughout the reaction, and the agitator was set at 20 rpm. The reactants were heated from ambient temperature (20°–25° C.) to 80° C. in 20 minutes and held at 80° C. for 30 minutes. Then 0.1% (based on total weight of monomers) of t-butyl peroxypivalate (Lupersol® 11) was charged into the kettle and the reaction temperature was held at 80° C. For 2 hours. Thereafter 0.05% (based on total weight of monomers) of Lupersol® 11 was added every 2 hours and the reaction temperature was held at 80° C. until the residual 4-vinylpyridine level was reduced to less than 2%.

Then 250 g of water and 55.4 g of sodium chloroacetate were mixed and charged. The mixture was heated to remove the distillate. Additional water was added while removing distillate until all the ethanol was removed at about 105° C. The final solids level was controlled by addition of water to the final product.

EXAMPLE 5

Example 4 was repeated using 25 g of 4-vinylpyridine, 75 g of vinylpyrrolidone and 27.7 g of sodium chloroacetate, with similar results.

EXAMPLE 6

Example 1 was repeated using 186.5 g of sodium 2-chloropropionate in place of sodium chloroacetate with similar results.

EXAMPLE 7

Example 1 was repeated using 186.5 g of sodium 1-chloropropionate with similar results.

EXAMPLE 8

A 1l, 4-necked resin kettle, fitted with anchor agitator, a nitrogen purge adaptor, a thermometer and a reflux condenser was charged with 150 g of 4-vinylpyridine and 150 g of isopropanol. The reactants were heated from ambient temperature (20°–25° C.) to 80° C. in 20 minutes and held at 80° C. for 30 minutes. Then 0.1% (based on total weight of monomers) of t-butyl peroxypivalate (Lupersol 11) was charged into the kettle and the reaction temperature was held at 80° C. for 2 hours. Then 0.05% (based on total weight of monomers) of Lupersol® 11 was added every 2 hours at 80° C. until residual 4-vinylpyridine was reduced to less than 2%.

The reaction mixture was cooled to 40° C. and 250 g of water and 57.2 g of sodium hydroxide were mixed and charged. Then 135.1 g of chloroacetic acid was pumped into the reactor by melting chloroacetic acid. The mixture was heated to remove the distillate, and water was added while removing distillate until all the ethanol was removed.

Examples of Liquid Fabric Softening Compositions

The following liquid softener compositions, when added to the rinse cycle of an automatic laundry operation, show dye transfer inhibition in the subsequent wash cycle.

| Components | Example 9 (Wt. %) |
|---|---|
| DTDMAC/MTTMAC* Blend (83%) | 4.5 |
| 1-Tallow(amidoethyl)-2-Tallowimidazoline | 3.4 |
| HCl | 0.2 |
| Polymer A (75% quat) | 0.5 |
| Perfume | 0.4 |
| Minor Ingredients** | 0.5 |
| Deionized Water | Balance |
| | 100.00 |

*Ditallowdimethylammonium chloride/monotallow-trimethyl-ammonium chloride

**Minor ingredients include: Dow Corning polydimethylsiloxane emulsion, calcium chloride, Kathon ® CG/ICP bacteriocide, and Liquitint ® Blue 65 dye.

EXAMPLE 9

The composition of Example 9 is made by the following procedures:

Adding Polymer A (75% quat) (average molecular weight of about 10,000, either as a powder or in aqueous solution)

with mixing to a vessel containing deionized water, heated to about 65° C. Molten DTDMAC/MTTMAC blend (at about 80° C.) is added with high shear mixing to the aqueous solution. After softener incorporation, the mixture is cooled, and the minor ingredients are added during the cooling process.

Examples of Fabric Conditioning Substrate Articles

The following fabric conditioning compositions and substrate articles, when added to the tumble dryer with the wet laundry load, show dye transfer inhibition in the subsequent wash cycle.

| Components | Example 10 (Wt. %) |
|---|---|
| DTDMAC | 80.00 |
| Calcium Bentonite Clay | 4.00 |
| Polymer A (75% quat) | 16.00 |
| Total | 100.00 |

EXAMPLE 10

Preparation of the Coating Mix

An approximately 200 gram batch of the coating mix is prepared as follows. An amount of about 160 g of ditallowdimethylammonium chloride (DTDMAC) is melted at 80° C. The calcium bentonite clay (about 8 g of Bentolite L, available from Southern Clay Co.) is slowly added to the mixture with high shear mixing. During the mixing, the mixture is kept molten in a boiling water bath. About 32 g of Polymer A (75% quat) is then slowly added to the mixture with high shear mixing, and the formula is mixed until the mixture is smooth and homogenous.

Preparation of Fabric Conditioning Sheets

The coating mixture is applied to preweighed nonwoven substrate sheets of about 9 inch×11 inch (approximately 23 cm×28 cm) dimensions. The substrate sheets are comprised of 70% 3-denier, 1 9/16-inch (approximately 4 cm) long rayon fibers with 30% polyvinyl acetate binder. The substrate weight is about 16 g per square yard (about 1.22 g/sheet). A small amount of formula is placed on a heated metal plate with a spatula and then is spread evenly with a wire metal rod. A nonwoven substrate sheet is placed on the metal plate to absorb the coating mixture. The sheet is then removed from the heated metal plate and allowed to cool to room temperature so that the coating mix can solidify. The sheet is weighed to determine the amount of coating mixture on the sheet. The target coating is 2.0 g per sheet. If the weight is in excess of the target weight, the sheet is placed back on the heated metal plate to remelt the coating mixture and remove some of the excess. If the weight is under the target weight, the sheet is also placed on the heated metal plate and more coating mixture is added.

| Components | Example 11 (Wt. %) |
|---|---|
| Octadecyldimethylamine | 11.89 |
| $C_{12-14}$ Fatty Acid | 8.29 |
| $C_{16-19}$ Fatty Acid | 10.69 |
| DTDMAMS | 19.32 |
| Sorbitan Monostearate | 19.32 |
| Clay | 3.86 |
| Polymer A (75% quat) | 26.62 |
| Total | 100.00 |

EXAMPLE 11

Preparation of the Coating Mix and Fabric Conditioning Sheets

A first blend of about 11.89 parts octadecyldimethylamine (Ethyl Corporation), 8.29 parts $C_{12-14}$ fatty acid (The Procter & Gamble Co.), and 10.69 parts $C_{16-18}$ fatty acid (Emery Industries, Inc.) are melted together at 80° C., and a second blend of about 19.32 parts sorbitan monostearate (Mazer Chemicals, Inc.) and 19.32 parts ditallowdimethylammonium methylsulfate, DTDMAMS, (Sherex Chemical Co.) are melted together to form the softener component of the composition during which time the mixture is kept molten in a boiling water bath. The calcium bentonite clay (3.86 parts Bentolite L, available from Southern Clay Co.) is then slowly added to the mixture while high shear mixing. An amount of about 26.62 parts of Polymer A is then added in small portions, and the formula is mixed until the mixture is smooth and completely homogenous.

The coating mixture is applied to preweighed nonwoven substrate sheets as in Example 10. The target coating is 2.33 g per sheet. Each sheet contains about 1.62 g of softener, about 0.09 g of clay, and about 0.62 g of Polymer A.

| Components | Example 12 (Wt. %) |
|---|---|
| Octadecyldimethylamine | 10.88 |
| $C_{12-14}$ Fatty Acid | 7.58 |
| $C_{16-19}$ Fatty Acid | 9.78 |
| DTDMAMS | 17.67 |
| Sorbitan Monostearate | 17.67 |
| Clay | 3.54 |
| Polymer A (75% quat) | 15.00 |
| Perfume/Cyclodextrin Complex | 15.44 |
| Free Perfume | 2.44 |
| Total | 100.00 |
| Coating Wt. per Sheet (g) | 2.55 |

EXAMPLE 12

Preparation of Coating Mix and Fabric Conditioning Sheets

The softener mixture of Example 12 is prepared similarly to that of Example 11. However, the coating mixture of Example 12 contains both perfume in the free state and perfume complexed with β-cyclodextrin. The free perfume provides the initial perfume odor to the dry fabrics, while the complexed perfume is used to provide the freshness impression to the re-wetted fabrics. The target coating is 2.55 g per sheet. Each sheet contains about 1.62 g of softener, about 0.09 g of clay, 0.38 g of Polymer A, about 0.40 g of perfume/cyclodextrin complex, and about 0.062 g of free perfume.

Examples of Solid, Particulate Fabric Softening Compositions

The following solid softener compositions can be reconstituted into liquid compositions. When added to the rinse cycle of an automatic laundering operation, these liquid compositions show dye transfer inhibition in the subsequent wash cycle.

The solid particulate compositions herein effectively disperse following simple addition to lukewarm water with gentle agitation (e.g., manual shaking). Improved results are obtained by using higher temperatures and/or effective mixing conditions, e.g., high shear mixing, milling, etc. However, even the mild conditions provide acceptable aqueous compositions.

| Components | Example 13 (Wt. %) |
|---|---|
| Sorbitan Monostearate | 74.3 |
| Cetyltrimethylammonium Bromide | 24.8 |
| Polymer A (75% quat) | 0.9 |
| Total | 100.0 |

EXAMPLE 13

A homogeneous mixture of cetyltrimethylammonium bromide (CTAB) and sorbitan monostearate (SMS) is obtained by melting SMS (about 165 g) and mixing CTAB (about 55 g) therein. The solid softener product is prepared from this "co-melt" by one of two methods: cryogenic grinding (at about −78° C.) to form a fine powder, or (b) prilling to form particles of particle size of from about 50 to about 500 $\mu$m.

Cryogenic Grinding

The molten mixture is frozen in liquid nitrogen and ground in a Waring blender to a fine powder. The powder is placed in a dessicator and allowed to warm to room temperature, yielding a fine, free flowing powder (granule).

Prilling

The molten mixture (at about 88° C.) falls about 1.5 inches at a rate of about 65 g/min. onto a heated (about 150° C.) rotating (about 2,000 rpm) disk. As the molten material is spun off the disk and air cooled (as it radiates outward), neat-spherical granule particles form with particle size of from about 50 to about 500 $\mu$m.

About 1 g of Polymer A powder of average MW of about 10,000 is added to and intimately mixed with about 110 g of the solid particulate softener composition to make the solid, particulate fabric softening composition of Example 13.

This solid, particulate fabric softener can be added directly to the rinse, or can be used to prepare a liquid softener. To make a conventional liquid softener about 111 g of solid particles is dispersed in about 889 g of warm water at about 40° C. and vigorously shaken for approximately 5 minutes. Upon cooling, the aqueous product remains in a homogeneous emulsified, or dispersed, state. Addition of this liquid product or the solid, particulate product to the rinse cycle of a washing process provides fabric softening and dye transfer inhibition characteristics.

| Components | Example 14 (Wt. %) |
|---|---|
| DEQA[1] | 60.0 |
| PGMS[2] | 17.4 |
| Coconut Choline Ester Chloride | 8.6 |
| Polymer A | 10.5 |

-continued

| Components | Example 14 (Wt. %) |
|---|---|
| Minor Ingredients (Perfume; Antifoam) | 3.5 |
| Total | 100.0 |

[1]Di(tallowoyloxethyloxyethyl)dimethyl ammonium chloride.
[2]Polyglycerol monostearate having a trade name of Radiasurf ® 7248.

EXAMPLE 14

About 60 parts of molten DEQA is mixed with about 8.6 parts of molten coconut choline ester chloride and about 17.4 parts of molten PGMS. About 10.5 parts of powdered Polymer A of average molecular weight of about 50,000 is then added. The active mixture is cooled and solidified by pouring onto a metal plate, and then ground. Trace of solvent is removed by a Rotovapor® (about 2 hrs. at about 40°–50° C. at maximum vaccum). The resulting active powder is ground and sieved to make the solid, particulate fabric softening product. The reconstitution of the powder into a liquid softener product is made as follows: About 900 of tap water is heated to about 35° C. (about 95° F.). About 10 g of antifoam and about 2.5 g of perfume are added to the water. About 96.5 g of the active powder is sprinkled on the water under continuous agitation. This resulting product is cooled by means of a cooling spiral prior to storage.

What is claimed is:

1. A fabric softening composition capable of reducing the transfer of dyes during subsequent wash cycles comprising:

I. about 3% to about 99% by weight of fabric softening agent; and

II. about 0.03% to about 80% by weight of water-soluble polymeric dye transfer inhibitor which is a poly (vinylpyridine)betaine containing a quaternary nitrogen and a carboxylate salt having dye transfer inhibitor properties having the formula:

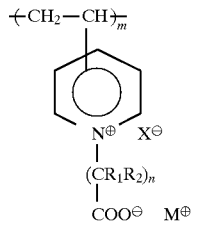

where m defines a repeating unit;

X is an anion;

R and $R_2$ are independently hydrogen, alkyl or aryl;

n is 1–5; and

M is a cation; and copolymers thereof.

2. A composition according to claim 1 wherein the composition is essentially free of aerosol propellant; bleach; sachets containing an active ingredient; anionic surfactant; and additionally for liquid compositions, essentially free of large amounts of highly ethoxylated and/or propoxylated material when the fabric softening agent is methyl-1-oleylamidoethyl-2-oleylimidazolinium methosulfate, or analogous agent, and additionally, for dryer-added compositions, essentially free of polymer-coated soil release polymers.

3. A liquid composition according to claim 1 comprising:

(a) from 3% to 50% of a fabric softening agent; and (b) from 0.03% to 25% of said dye transfer inhibitor.

4. A dryer-added composition according to claim 1 comprising:

(a) from 50% to 99% of a fabric softening agent; and (b) from 0.2% to 50% of said dye transfer inhibitor.

5. A composition according to claim 4 wherein said dye transfer inhibitor has a particle size of 0.5 mm or smaller.

6. A composition according to claim 1 which includes from 5% to 40% perfume/cyclodextrin complex, from 10% to 40% of polymeric soil release agent, and a dispensing means which provides for release of an effective amount of the composition to fabrics.

7. A solid particulate composition according to claim 1 comprising:

(a) from 20% to 90% of fabric softening agent;

(b) from 0.1% to 80% of said dye transfer inhibitor; and (c) optionally, from 0% to 45% of a dispersing agent.

8. A composition according to claim 1 in which X is a halide.

9. A composition according to claim 8 in which X is chloride or bromide.

10. A composition according to claim 1 in which said polymer has a weight average molecular weight of about 5,000 to 1,000,000.

11. A composition according to claim 1 in which $R_1$ and $R_2$ are both hydrogen.

12. A composition according to claim 1 in which n is 1.

13. A composition according to claim 1 in which M is an alkali metal.

14. A composition according to claim 13 in which M is sodium or potassium.

15. A composition according to claim 1 in which m is 30–5000.

16. A composition according to claim 15 in which m is 100–1000.

17. A composition according to claim 1 in which said polymer is 25–100% quaternized.

18. A composition according to claim 11 in which said polymer is 75–100% quaternized.

19. A composition according to claim 1 in which said dye transfer inhibitor is a water soluble copolymer of said polymer with a polymerizable comonomer.

20. A composition according to claim 19 which is a water soluble copolymer of said polymer with vinylpyrrolidone, vinyl caprolactam, vinyl imidazole, N-vinyl formamide or acrylamide.

21. A composition according to claim 1 in which said polymer is poly(4-vinylpyridine)sodium carboxymethyl betaine chloride.

22. A composition according to claim 1 which includes about 0.01–25% by weight of the polymer of claim 1.

* * * * *